US007420884B2

(12) United States Patent
Dubach et al.

(10) Patent No.: US 7,420,884 B2
(45) Date of Patent: Sep. 2, 2008

(54) TIMEPIECE DIAL AND PROCESSES FOR MANUFACTURING THIS DIAL

(75) Inventors: Roland Dubach, Gillarens (CH); Hilario Gomes, Annecy-le-Vieux (FR); Alexandra Prodromides, Saint Julien en Genevois (FR)

(73) Assignee: Rolex S.A., Geneva (CH)

( * ) Notice: Subject to any disclaimer, the term of this patent is extended or adjusted under 35 U.S.C. 154(b) by 112 days.

(21) Appl. No.: 11/300,257

(22) Filed: Dec. 14, 2005

(65) Prior Publication Data

US 2006/0133219 A1 Jun. 22, 2006

(30) Foreign Application Priority Data

Dec. 20, 2004 (EP) ..... 04405784

(51) Int. Cl.
*G04B 19/06* (2006.01)

(52) U.S. Cl. ..... 368/232; 29/896.32

(58) Field of Classification Search ..... 368/232
See application file for complete search history.

(56) References Cited

U.S. PATENT DOCUMENTS

| | | | | |
|---|---|---|---|---|
| 3,786,627 | A * | 1/1974 | Takagi et al. | 368/232 |
| 5,049,221 | A * | 9/1991 | Wada et al. | 156/151 |
| 2002/0068148 | A1 * | 6/2002 | Nakamura et al. | 428/131 |
| 2007/0092734 | A1 * | 4/2007 | Durandeau et al. | 428/432 |

FOREIGN PATENT DOCUMENTS

| | | |
|---|---|---|
| FR | 2162349 | 7/1973 |

* cited by examiner

*Primary Examiner*—Felix O. Figueroa
*Assistant Examiner*—Sean Kayes
(74) *Attorney, Agent, or Firm*—Sturm & Fix LLP

(57) ABSTRACT

The surface of metallic appearance of the timepiece dial has a visible morphology corresponding to that of mother-of-pearl. According to the process for manufacturing this dial, a mother-of-pearl sheet is subjected to a sandblasting operation, to give its surface finish the morphology of mother-of-pearl, this surface is cleaned and coated with a layer of metallic appearance.

6 Claims, 1 Drawing Sheet

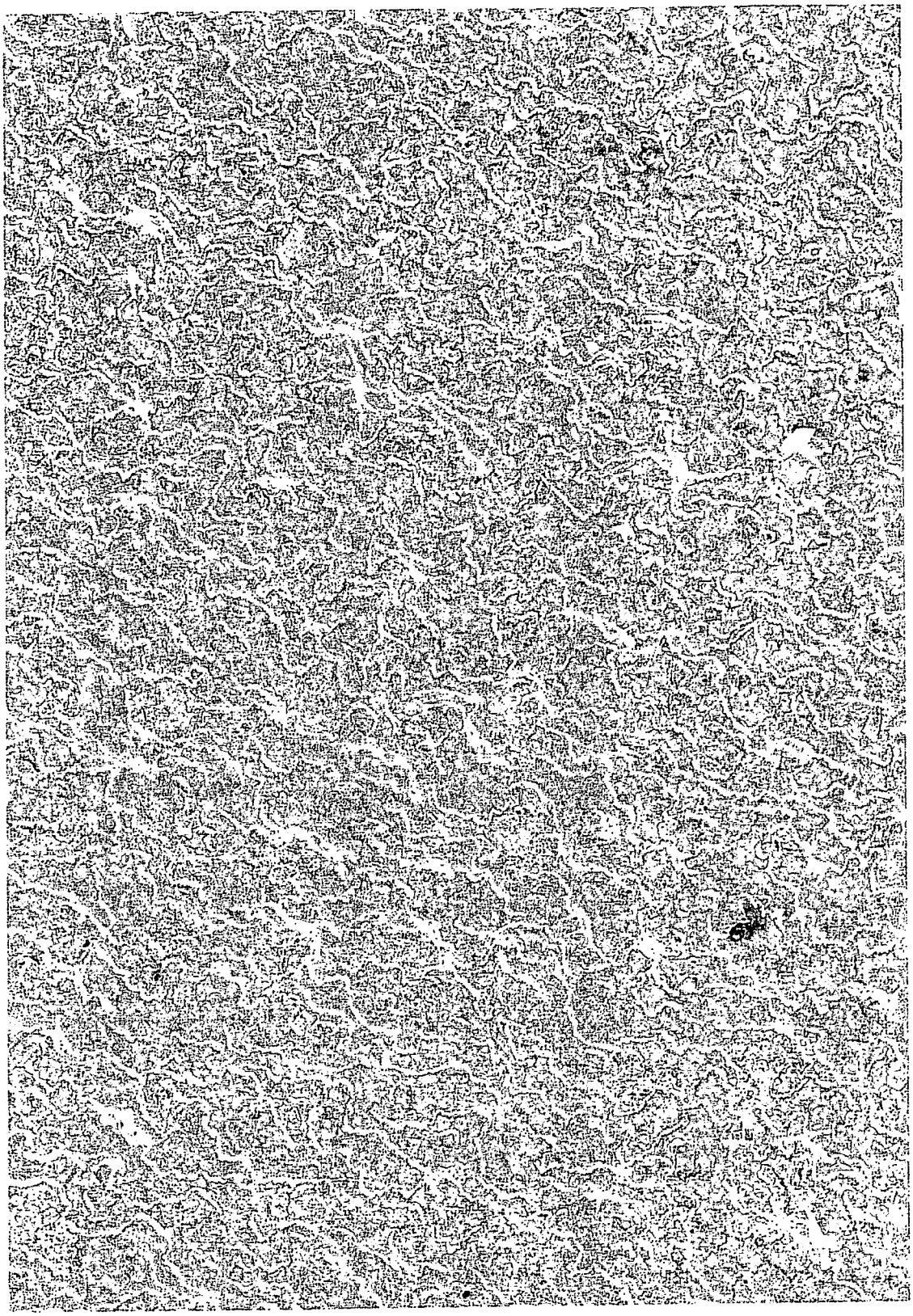
Figure unique

TIMEPIECE DIAL AND PROCESSES FOR MANUFACTURING THIS DIAL

CROSS REFERENCE TO RELATED APPLICATIONS

This application claims priority of European Applicaton No. 04405784.2 filed Dec. 20, 2004, which is included in its entirety by reference made hereto.

BACKGROUND OF THE INVENTION

1. Field of the Invention

The present invention relates to a timepiece dial, the visible surface of which has a metallic appearance, and to two processes for manufacturing this dial.

2. Description of the Related Art

A very large variety of surface types are known for watch dials. This variety, which is dictated by concern to vary as much as possible one of the essential elements of the trim of a timepiece, giving it its aesthetically attractive appearance, comes from the choice of materials, colours and surface finish of these surfaces, which may form decorative features.

Already used from among this variety of materials for obtaining particular surface effects are, apart from the most common form of mother-of-pearl, lined, pearly white, pink, black or yellow mother-of-pearl. The mother-of-pearl used for dials is available on the market in the form of thin discs or sheets that are polished on the side intended to form the front face of the dial. Apart from the iridescent reflections from mother-of-pearl, the translucent nature of mother-of-pearl reveals its stratified structure, which gives it a characteristic morphology, even when its surface is polished.

US 2002/0068148 A1 has already proposed a decorative sheet for a timepiece dial produced from a mother-of-pearl sheet on which a spiralled groove of rectangular cross section has been etched. The inclination of the triangular faces of this groove progressively changes, giving the illusion that the flat surface is domed. The surface thus treated is then covered with a transparent layer. Such a surface therefore has the appearance of a domed mother-of-pearl surface.

A dial has also been proposed, in FR 2 162 349, which consists of a thin metal base plate to which a thin mother-of-pearl sheet is adhesively bonded. To prevent the irregularities due to the bonding being seen through the mother-of-pearl sheet owing to its transparency, a coating is applied, by a non-electrical means, to the back of this mother-of-pearl sheet. The colour of the coating layer or paint and the refraction of the mother-of-pearl combines so as to produce a particular attractive effect.

BRIEF SUMMARY OF THE INVENTION

The object of the present invention is to renew the surface finish appearance of the metal surface of watch dials, thanks to a novel use of mother-of-pearl.

For this purpose, a first subject of the invention is a timepiece dial, the visible surface of which has a metallic appearance, characterized in that the surface finish of the said surface of metallic appearance has a morphology characteristic of that of mother-of-pearl.

Another subject of this invention is a process for manufacturing a timepiece dial, the visible surface of which includes a coating of metallic appearance, the surface finish of which has a morphology characteristic of that of mother-of-pearl, according to Claim 5. Yet another subject of the invention is a process for manufacturing this dial according to Claim 7.

It has been found, fortuitously, that the metallization of the mother-of-pearl using the processes according to the present invention make it possible to reproduce the intrinsic morphology of mother-of-pearl, as it appears on a sheet of polished mother-of-pearl thanks to the translucency of mother-of-pearl, and thus to give a very particular surface finish to the surface of metallic appearance. This morphology is revealed thanks to a specific roughness intrinsic to the stratified nature of mother-of-pearl, which causes decorative features to appear that have the property of being unique for each mother-of-pearl sheet, since this is a natural material produced by a living organism. Moreover, the surface finish of the substrate that receives the coating, characteristic of the mother-of-pearl morphology, ensures excellent bonding of the coating.

The existence of two separate processes having a common inventive concept stems from the fact that the coating of metallic appearance may be produced either directly on sandblasted mother-of-pearl or on a replica produced using this sandblasted mother-of-pearl. In one case, the morphology of the metallic coating is unique, since each mother-of-pearl sheet is different, whereas in the other case it is possible to reproduce the same morphology as many times as desired.

The following description describes, by way of example, various methods of implementing the processes for manufacturing a timepiece dial, the said processes being one subject of the present invention.

BRIEF DESCRIPTION OF THE DRAWINGS

The single appended FIGURE is a scanning electron microscope photograph of ×1000 magnification, showing the surface finish of a mother-of-pearl sheet that has received a metallic coating after having been subjected to the preparatory phase of the process according to the present invention.

DETAILED DESCRIPTION OF THE INVENTION

The timepiece dial according to the present invention may be obtained essentially in two ways, either, preferably, by coating a pre-sandblasted mother-of-pearl sheet with metal, or by producing a replica of a pre-sandblasted mother-of-pearl sheet using a mould, obtained by moulding the mother-of-pearl, as will be explained later.

We will firstly describe the steps of the process that are needed in both cases, namely the means used to reveal the mother-of-pearl morphology, which is normally visible only because of its translucency properties. This is because, if a mother-of-pearl sheet as used to form the visible surface of a watch dial were to be coated, a smooth surface would simply be obtained and all the properties specific to the mother-of-pearl morphology would be lost, which would be of no interest.

This first step consists in subjecting the mother-of-pearl surface intended to form the visible surface of the dial to a sandblasting operation in aqueous medium. The grit used is silicon carbide (SiC) having a particle size varying between 15 and 50 μm, with a mean value of 27 μm. The aqueous suspension is prepared by mixing 1 liter of SiC with 10 liters of softened municipal town supply water and 400 g of a gel intended to increase the viscosity of the suspension, so as to increase the viscosity of the liquid and keep the SiC particles in suspension in this liquid.

The viscosity of this suspension was measured by placing 100 ml of suspension in a beaker for measuring viscosity according to the DIN 53 211 standard, fitted with a 4 mm diameter nozzle. The measured flow time was 11 seconds.

The suspension is sprayed onto the mother-of-pearl surface to be treated, with a pressure of between $3\times10^5$ and $5\times10^5$ Pa, the distance between the nozzle for spraying the suspension and the mother-of-pearl surface to be treated being 10 cm. The mother-of-pearl discs intended to form the backs of dials are placed on a work support formed, in this example, by a rotating plate. The mother-of-pearl discs of the desired size for timepiece dials are distributed around a circle 370 mm in diameter concentric with the rotation spindle of this plate, which rotates at a rate of one revolution per three minutes.

This sandblasting operation is followed by a cleaning operation, washing for three minutes with hard water and one minute with soft water, followed by a cleaning operation using an alkaline detergent of 11 pH.

The mother-of-pearl used may be white, pearly white or pink mother-of-pearl, namely Pteria margaritifera or Meleagrina margaritifera from Australia or Japan. The mother-of-pearl may be pink, namely Potamilus purpurata from the USA. Finally, it may be black, namely Pinctada margaratifera from Polynesia.

After the operations of sandblasting the mother-of-pearl substrates in aqueous medium and of cleaning them, it is preferable to coat these substrates with a layer of pure yellow gold (Au), a layer of grey platinum (Pt) or a layer of a pink gold/copper (Au/Cu) alloy. These layers are produced by PVD (physical vapour deposition) under the conditions that will be explained later.

To produce the coating on the mother-of-pearl substrate faces that are intended to form the visible surfaces of dials, by PVD-MS (physical vapour deposition magnetron sputtering), the mother-of-pearl sheets obtained after the sandblasting and cleaning operations are placed on a work support positioned so as to face a target in a vacuum coating chamber, with the sandblasted faces of the sheets turned towards the target.

Firstly, the surfaces of the sheets to be coated that are intended to form the visible surfaces of watch dials undergo ion etching. During this etching operation, the target is separated from the work support carrying the mother-of-pearl sheets by a target mask. This etching is carried out after creation of a vacuum ($8\times10^{-4}$ Pa) in the chamber, injection of argon (at 4 Pa) and formation of a plasma for 10 minutes, the operating power used for the plasma being 10 W.

The target is then etched under the same conditions, the operating power used for the plasma then being 50 W.

The argon pressure is then adjusted to the working pressure ($7\times10^{-1}$ Pa) and the support for the substrates to be coated is RF (radiofrequency) biased, simultaneously removing the target mask, and the RF deposition is carried out by sputtering from the target cathode for 30 minutes.

The operating power levels during the deposition vary depending on the target (Au, Pt or AuCu) from 30 to 350 W for the targets and from 5 to 150 W for the substrates.

The parts are cooled by a room-temperature water circuit, the water circulating through the support for the parts to be coated throughout the duration of the deposition.

The distance between the target and the substrates is between 4 and 15 cm.

Next, the bias and the plasma are removed, and the chamber cooled by a stream of argon.

The thickness of the deposited layer may typically vary from 100 nm to 1000 nm (i.e. 0.1 μm to 1 μg/m). This thickness is chosen so as to maintain, as faithfully as possible, the mother-of-pearl morphology as revealed by the sandblasting operation. The result obtained may be seen in the appended FIGURE, which relates to a sandblasted mother-of-pearl substrate coated with a 500 nm layer of pure gold.

It would also be possible to coat the substrate by PVD using a DC current instead of an RF current.

In a variant of the above process, instead of coating the mother-of-pearl substrate, the mother-of-pearl could be used to produce replicas and these replicas would be coated. As already mentioned above, the drawback of this variant is that the resulting product then becomes perfectly standard and the exclusivity, obtained if the coated substrate is mother-of-pearl itself which, given the unique surface morphology that it has, gives this dial the character of a deluxe product, is lost.

The main advantage of the mother-of-pearl substrate really lies in the fact that it makes it possible to obtain, by an industrial process, a dial of metallic appearance whose surface morphology will never be the same from one dial to another, something that is obviously not the case if the alternative process of mother-of-pearl replicas is used, given that it would not be possible to make a different mould for each dial, each mould being intended to produce an almost unlimited number of dials.

To produce these replicas, several methods are possible, especially the techniques of electroforming, ceramic injection and plastic metallization.

In all cases, the process would start with a mother-of-pearl sheet that has undergone the abovementioned steps of sandblasting in aqueous medium and of cleaning.

To reproduce the morphology of the mother-of-pearl surface thus obtained, a plastic is injected onto this mother-of-pearl surface in order to take an imprint thereof. The injected plastic is removed from the mother-of-pearl sheet and this imprint is metallized by PVD deposition of a thin film (typically 0.1-1 μm in thickness) of a noble metal or a noble metal alloy (especially Au, Pt or AuCu), as indicated above and using a very similar operating process. Next, a thick metal coat is grown on this thin film by electroplating, intended to form the dial. This coat is preferably made of a non-noble metal, such as copper, nickel or silver, and finally the plastic is dissolved so as to reveal the replica of the initial mother-of-pearl sheet on the substrate formed by the thick coat obtained by electroplating.

Other known techniques for forming replicas could be used. For example, a mould could be formed by means of an imprint of the sandblasted and cleaned mother-of-pearl surface, as described above, the imprint being taken using a silicone. A replica would be produced in this mould by injecting or pressing a ceramic, such as alumina powder. The ceramic would be left to dry and then removed from the mould, the binders contained in the ceramic would be burnt off and the replica would be sintered.

The invention claimed is:

1. Process for manufacturing a decorative plate for a timepiece dial, a front surface of which is a coating of metal, metallic oxide, nitride or carbide material, the surface finish of which has an apparent morphology characteristic of that of a polished mother-of-pearl surface, wherein a polished mother-of-pearl sheet is subjected to a sandblasting operation, in order to give it a surface finish corresponding to the apparent morphology of this mother-of-pearl, the surface is cleaned and coated with a metal layer or layer of metallic oxide, nitride or carbide.

2. Process according to claim 1, in which the sand-blasted mother-of-pearl sheet is coated, by physical vapour deposition (PVD) magnetron sputtering of a target, with at least one coating element.

3. Process according to claim 1, in which the said sandblasting operation is carried out in aqueous medium.

4. Process according to claim 2, in which the said sandblasting operation is carried out in aqueous medium.

5. Process for manufacturing a decorative plate for a timepiece dial according to claim 1, wherein a mother-of-pearl sheet is subjected to a sandblasting operation, in order to give it a surface finish characteristic of its apparent morphology, this surface is cleaned, an impression of this surface is taken, a replica of said mother-of-pearl sheet is formed and this replica is coated with a metal layer or with a layer of metallic oxide, nitride or carbide.

6. Process according to the claim 5, in which the said sandblasting operation is carried out in aqueous medium.

* * * * *